US005396955A

United States Patent [19]

Howlett

[11] Patent Number: 5,396,955

[45] Date of Patent: Mar. 14, 1995

[54] METHOD TO SELECTIVELY AFFECT PERMEABILITY IN A RESERVOIR TO CONTROL FLUID FLOW

[75] Inventor: Donald L. Howlett, Kingwood, Tex.

[73] Assignee: Texaco Inc., White Plains, N.Y.

[21] Appl. No.: 155,336

[22] Filed: Nov. 22, 1993

[51] Int. Cl.[6] ..... E21B 43/25; E21B 37/00; E21B 43/22

[52] U.S. Cl. ..... 166/249; 166/177; 166/311

[58] Field of Search ..... 166/249, 177, 245, 65.1, 166/53, 268, 311

[56] References Cited

U.S. PATENT DOCUMENTS

| | | | |
|---|---|---|---|
| 4,008,459 | 2/1977 | Walker, Jr. | 367/56 |
| 4,280,558 | 7/1981 | Bodine | 166/249 |
| 4,345,650 | 8/1982 | Wesley | 166/249 |
| 4,417,621 | 11/1983 | Medlin et al. | 166/249 |
| 4,432,078 | 2/1984 | Silverman | 166/249 X |
| 4,679,627 | 7/1987 | Harrison | 166/249 |
| 4,969,129 | 11/1990 | Currie | 367/41 |
| 5,042,611 | 8/1991 | Howlett | 181/104 |
| 5,282,508 | 2/1994 | Ellingsen et al. | 166/249 |

*Primary Examiner*—Stephen J. Novosad
*Attorney, Agent, or Firm*—Kenneth R. Priem; James L. Bailey

[57] ABSTRACT

A method for selectively affecting the permeability of reservoirs to enhance fluid flow therein includes placing a plurality of acoustical wave generator means in a patterned array with respect to the reservoir and energizing them to create acoustic nodes at targeted areas of the reservoir. The acoustic wave generator means can be located solely on the surface, only below surface or in combination above and below surface. The acoustic wave generator means can be selectively simultaneously or sequentially energized to create nodes at targeted areas of the reservoir.

5 Claims, 3 Drawing Sheets

METHOD TO SELECTIVELY AFFECT PERMEABILITY IN A RESERVOIR TO CONTROL FLUID FLOW

BACKGROUND OF THE INVENTION

1. The Field of the Invention

The present invention relates to the use of low frequency energy (in the acoustic range) to selectively affect the permeability in a reservoir to control fluid flow and, in particular, to a technique involving the use of synchronized vibratory sources spaced in a patterned array with respect to the reservoir to impart low frequency energy which can be focused selectively on localized zones within the reservoir.

2. The Prior Art

It is well known to use acoustic wave energy for the purpose of making seismic surveys, see U.S. Pat. No. 4,008,459 for example. It is also well known to impress a coding format on these acoustic wave signals to obviate problems with interference and/or false returns, see U.S. Pat. No. 4,969,129 for example. It is further well known to place acoustic wave generating sources down well bores and to conduct seismic surveying subsurface between wells, see U.S. Pat. No. 5,042,611 for example. However, no one to date has proposed to apply acoustic wave energy to a formation in such a manner as to improve the production therefrom.

There are a number of publications which suggest that the application of acoustic energy to a reservoir can possibly have an effect on the volume of fluids produced therefrom. This phenomena is not well understood and is not commonly used in the United States at this time. Although work was done in the area in the United States over twenty years ago, it was not subsequently actively pursued. The technique has been used to some extent in the former Soviet Union. There has been a recent revival of interest in this concept in the United States by several major oil companies.

SUMMARY OF THE INVENTION

The present invention improves the flow rate of fluid in a reservoir by providing a patterned array of acoustic devices about the reservoir and selectively energizing them in such fashion that the vibrational energy can be directed throughout the reservoir to focus in designated regions to encourage fluid flow other than through channels formed during conventional enhanced oil recovery operations. The vibratory energy sources can be synchronized to direct the resultant waves. The acoustic sources can be arranged in arrays at the surface (planar), in arrays suspended in a plurality of well bores (vertical), or in combination of surface (planar) and in-well (vertical) arrays.

BRIEF DESCRIPTION OF THE DRAWINGS

The present invention will now be described, by way of example, with reference to the accompanying drawings in which.

DETAILED DESCRIPTION OF THE INVENTION

The present invention utilizes a plurality of acoustic wave generators in a patterned array and means for controlling the acoustic wave generators in such fashion that the combined waves generated produce a controlled and defined acoustic wave pattern subsurface. It is possible to direct nodes formed by the acoustic waves, at points where the acoustic waves meet, by varying the output of individual acoustic wave generators.

Figure 1:
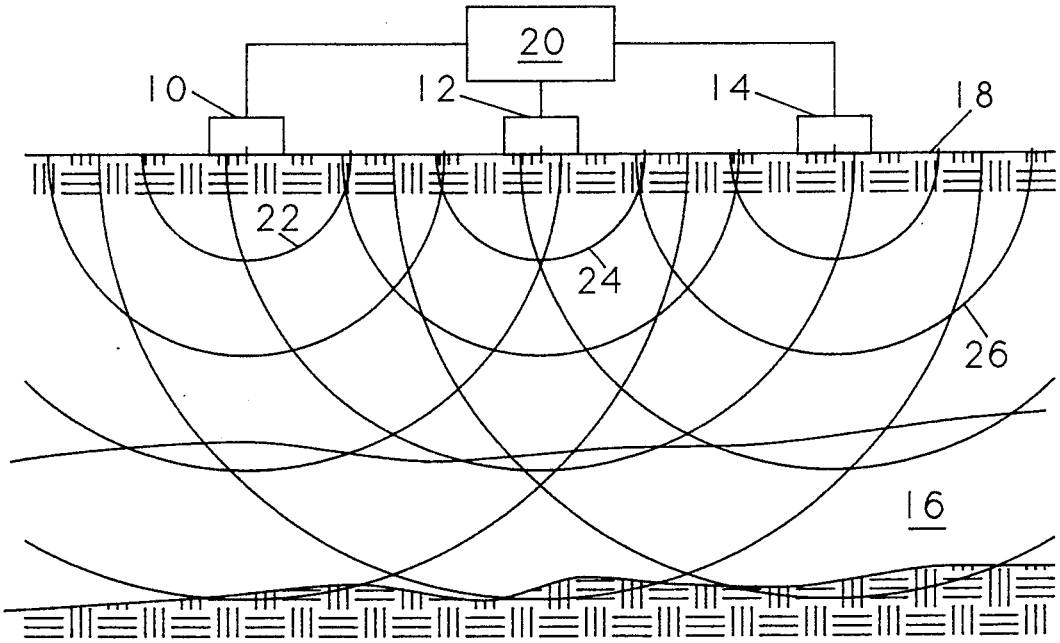
FIG. 1 is a schematic representation of a vertical section though a typical producing field with, in accordance with the present invention, a patterned array of acoustic wave generators at the surface and adapted to focus acoustic energy subsurface.

A first embodiment is shown in FIG. 1 wherein an array of acoustic wave generating sources 10, 12, 14 are placed in a patterned array with respect to a subsurface fluid reservoir 16. These acoustic wave generating sources, which can be selected from any of the well known types, are shown arranged in a planar array along the surface 18 of the earth. Acoustic wave generator control means 20 is provided operatively connected to energize the acoustic wave generating sources. The sources can be energized selectively, in synchronization, with various powers, with different frequencies, in different combinations or in any other known fashion to produce the desired subsurface acoustic wave patterns. Thus it is possible to produce a controlled and defined acoustic wave pattern selectively within any specific zone of the reservoir 16. The acoustic waves 22, 24, 26 emanating from the respective acoustic wave generating sources 10, 12, 14 will form a plurality of controlled nodes by adding in some regions while cancelling in other regions. By adjusting the relative phases and frequencies of the respective acoustic wave generating sources, it is possible to selectively steer the nodes of maximum amplitude to specific places in the reservoir.

Figure 2:
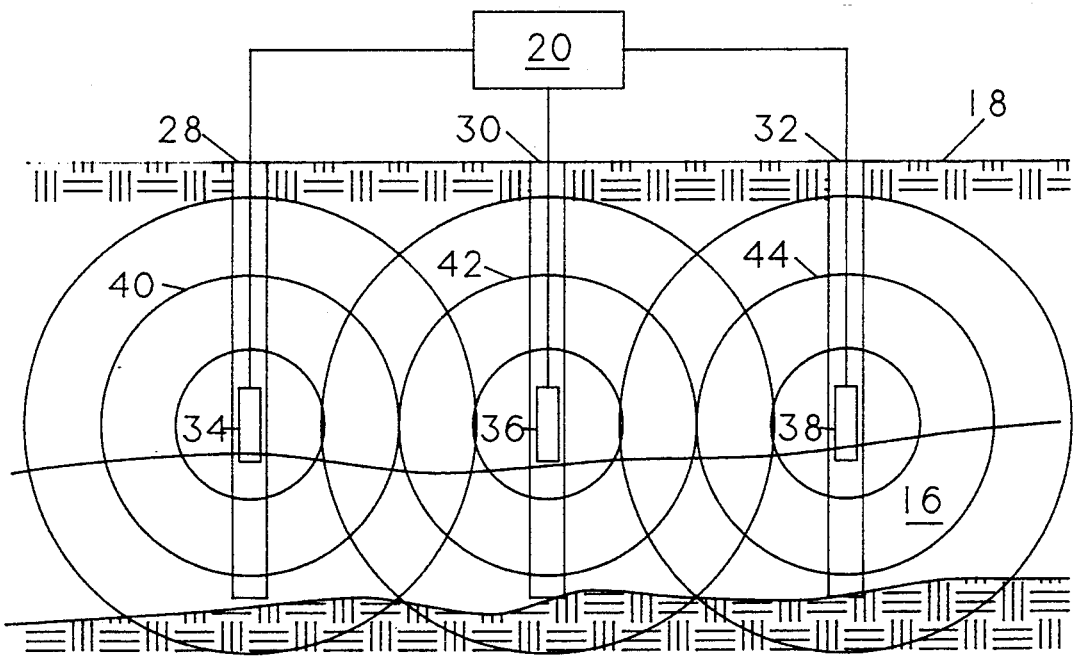
FIG. 2 is a schematic, similar to FIG. 1, showing a variation of the present invention with a plurality of acoustic wave generators suspended downhole.

An alternative embodiment is shown in FIG. 2 with a plurality of well bores 28, 30, 32 each having an acoustic wave generator 34, 36, 38, respectively, suspended therein. These generators produce acoustic waves 40, 42, 44, respectively.

Figure 3:
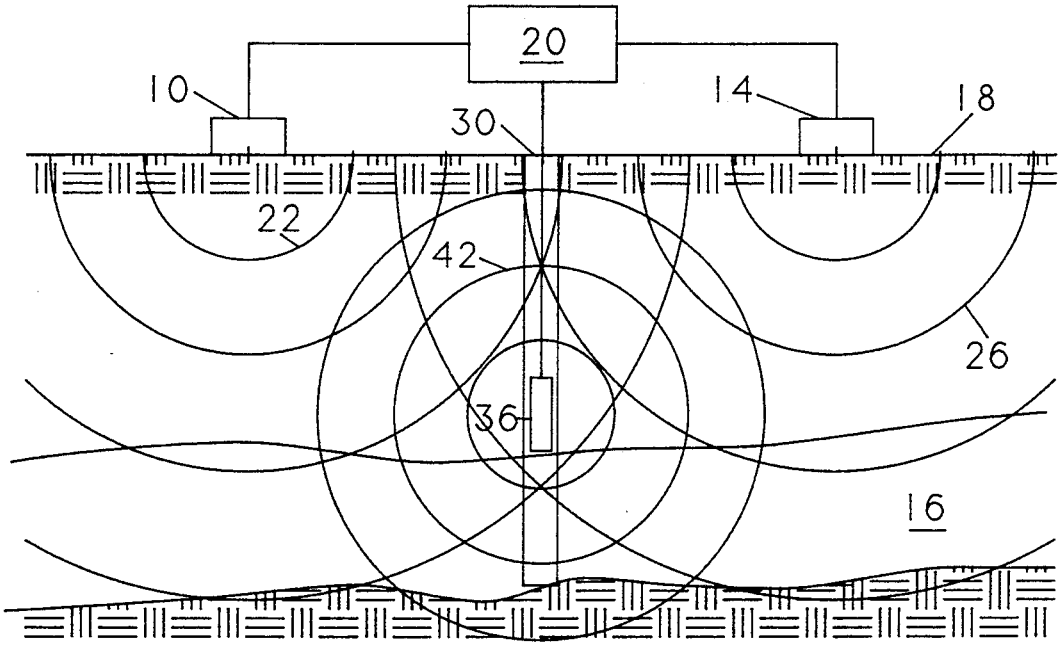
FIG. 3 is a schematic, similar to FIGS. 1 and 2, showing a further variation of the present invention with a combination of surface and down hole acoustic wave generators.

A further alternative embodiment is shown in FIG. 3 combining both surface mounted and well bore suspended acoustic wave generator sources. For convenience, like reference numerals have been used in FIG. 3 for like features and components appearing in FIGS. 1 and 2.

The acoustic waves can be generated either as steady signals or in short periodic pulses. Preferably they should be in the frequency range of 20–100 Hz for the surface mounted generating sources and 300–2000 Hz for the subsurface suspended generating sources in order to achieve wave prorogation over a reasonable distance in the reservoir field.

By selectively focusing the acoustic energy in a specific region, it should be possible to encourage fluid flow of hydrocarbons in the reservoir through channels other than those formed during standard enhanced oil recovery operations. The passage of the acoustic waves through the formation should have a controlling effect on the rate of chemical reactions involved in the various known well treatment chemicals and/or foaming agents injected during enhanced oil recovery operations. The present invention should provide a means to cause the desired chemical action of a known secondary recovery treatment to occur in specific regions where that treatment is required. The acoustic waves could also be used to influence the direction of flow taken by the injected chemicals.

It should be noted that there are two basic embodiments of the present invention, which embodiments could be used either separately or in combination as a third embodiment. The first embodiment provides an array formed by a plurality of acoustic wave generating sources distributed about the surface over a known reservoir. The second embodiment provides a plurality of acoustic wave generating sources suspended in an array of boreholes throughout the reservoir site. Each suspended array can have more than one acoustic wave generating source. The combination would be to have acoustic wave generating sources both at the surface and suspended in selected boreholes thereby creating a three dimensional array of acoustic wave generating sources.

There are a number of reservoir parameters which must be determined and which could be critical to the effective use of the present invention. For example, mud filtration damage reduction, fines migration damage reduction, flow enhancement, paraffin damage removal, polymer completion fluid damage reduction are all considerations which must be taken into account. Each of these reflect on the condition of the reservoir from prior treatment and which would have a direct effect on the application of the present invention to that reservoir.

The formation of scale and various other deposits in production and injection wells has been a recognized problem for many years. This problem arises because moving fluids carry with them, or gather enroute, various minerals and chemical elements indigenous to their originating or surrounding environment. These minerals and/or elements may remain in solution and/or suspension as long as the physical conditions in the reservoir remain reasonably constant, namely, temperature, pressure, saturation level, rate of flow, etc. Changes in one or more of these conditions can allow the minerals and/or elements to precipitate or unite with other chemical forms causing a deposition of scale at the point of change. The buildup of scale is generally found formed in the wellbore, at the face of the formation, and for some limited radius around the wellbore into the formation, thus plugging off or sealing off the wellbore from the producing formation. In the past this condition has been treated mainly by further chemical operations or by mechanical methods including scrapers and reamers and explosive devices to create fracturing of the strata.

The present invention employs continuous application of high or ultra high frequencies upon the reservoir. The continuous influence causes extreme acceleration of molecular activity and sympathetic or resonant sonic pockets (nodes) begin to form in the material or transmitting medium. Given sufficient energy dissipation, this agitation can be increased to a point beyond material endurance and destruction occurs separating and breaking up the scale. Utilizing transducers, such as ceramic sonic generators, it was found that while the high frequency agitation performed well on thin scales, the effects were attenuated rapidly with penetration. Another drawback was that continuous power levels sufficient to destroy heavier accumulations tended to cause by the failure of the transducers.

Primary and secondary oil recovery efforts have historically been hampered by localized permeability damage caused by deposition of scale and other plugging materials. The heretofore methods for removing these plugging materials have been inadequate and the results generally are rather short lived. The application of sonic energy can be used to remove the deposits that are relatively unaffected by previous methods. It is to be expected that the present invention will have a longer lasting effect on correcting this situation.

It is to be understood that the acoustic generators can be designed to generate focused beams which then can be directed to intersect with similar beams at a particular substrate location to solve a particular problem, such as the abovementioned scale or deposition of materials.

The present invention may be subject to many modifications and changes without departing from the spirit or characteristics thereof. The present embodiments should therefore be considered in all respects as illustrative and not as restrictive as to the scope of the invention as defined by the appended claims.

I claim:

1. A method to selectively affect the permeability in a subterranean reservoir comprising the steps of:

providing a plurality of acoustical wave generator means in a patterned array; and selectively and sequentially energizing said plurality of acoustical wave generator means to generate vibrations from each said acoustical wave generator means whereby the vibrations thus generated create at least one node that can be directed to targeted areas of said reservoir by said selective and sequential energization to stimulate flow in said reservoir.

2. The method according to claim 1 wherein all of said acoustical wave generator means are located on the surface.

3. The method according to claim 1 wherein said acoustical wave generator means are located subsurface.

4. The method according to claim 1 where at least some of said acoustical wave generator means are located subsurface.

5. A method according to claim 1 wherein said acoustic wave generator means are controlled so that the frequency of the resulting acoustic waves is varied whereby the location of the nodes is controlled.

* * * * *